US008439236B2

(12) United States Patent
Okabe

(10) Patent No.: US 8,439,236 B2
(45) Date of Patent: May 14, 2013

(54) BRIDGE BREAKER

(76) Inventor: Shuichi Okabe, Kawaguchi (JP)

( * ) Notice: Subject to any disclaimer, the term of this patent is extended or adjusted under 35 U.S.C. 154(b) by 291 days.

(21) Appl. No.: 12/849,116

(22) Filed: Aug. 3, 2010

(65) Prior Publication Data

US 2012/0012619 A1 Jan. 19, 2012

(30) Foreign Application Priority Data

Jul. 16, 2010 (JP) ..... 2010-161419

(51) Int. Cl.
*B65D 88/64* (2006.01)

(52) U.S. Cl.
USPC ..... 222/411; 222/236; 222/342

(58) Field of Classification Search ..... 222/196, 222/199, 200, 216, 226, 342, 410, 411, 459, 222/236–242; 239/668, 683; 198/533; 241/225; 406/135; 366/281, 314; 384/511; *B65D 88/26, B65D 88/64; B65G 65/34*
See application file for complete search history.

(56) References Cited

U.S. PATENT DOCUMENTS

| | | | | |
|---|---|---|---|---|
| 3,278,091 | A * | 10/1966 | Kokeisl | 222/195 |
| 3,583,511 | A * | 6/1971 | Asberg | 180/370 |
| 3,845,886 | A * | 11/1974 | Kokeisl | 222/241 |
| 2006/0107779 | A1 * | 5/2006 | Tsou et al. | 74/424.88 |
| 2008/0174074 | A1 * | 7/2008 | Springer et al. | 277/402 |

FOREIGN PATENT DOCUMENTS

| | | | |
|---|---|---|---|
| JP | 2004315118 | A * | 11/2004 |
| JP | 2009-242040 | A | 10/2009 |

* cited by examiner

*Primary Examiner* — Kevin P Shaver
*Assistant Examiner* — Patrick M Buechner
(74) *Attorney, Agent, or Firm* — Holtz, Holtz, Goodman & Chick, P.C.

(57) ABSTRACT

A bridge breaker includes a casing and an inner ring. Balls are provided between the casing and the inner ring for rotatably supporting the inner ring, without independent ball bearings, so as to make for easy and cost-effective machining. Seal rings having a square shape section are laid on same horizontal level surfaces of the casing and the inner ring, and are depressed by air pressure for preventing powder from entering into the device and to avoid frequent exchange of packing. A blade having a shaft is fixed to the inner ring through a hole of the inner ring, to prevent problems caused by looseness or releasing of connecting bolts.

2 Claims, 5 Drawing Sheets

BRIDGE BREAKER

BACKGROUND OF THE INVENTION

1. Field of the Invention

The present invention relates to bridge breaker for the powder or particle (hereinafter called as powder) discharging system from receiving hopper to outside directly or downstream equipment. This device is usually equipped at the bottom of hopper and used to break plugging of powder (hereinafter called as bridge) happened at cone part of hopper by rotating a blade with motor.

Vibrator or knocker equipped at cone part of hopper is known for breaking bridge. But vibration or shock sometimes can't solve bridge, because powder is packed by vibration or shock and make situation worse. And wall of hopper is damaged by repeated stress for long period of operation by force of vibrator or knocker. Furthermore, in case of knocker, big noise happened.

Air injection into hopper is another way for breaking bridge. But in case of small amount of air, bridge can't be solved, and in case of large amount of air, releasing air from hopper is difficult because air contains a lot of powder, and much cost is required for air consumption.

The present invention relates to bridge breaker can solve bridge certainly without problems of damage of hopper, noise and cost for injection air.

2. Description of the Related Art

With respect to bridge breaker, the device as shown in FIG. 1 is used conventionally.

In this figure, upper part of the device is connected with flange C of hopper A having cone B by bolts, and lower part of the device is connected with flange D of downstream equipment. The clearance between flange C and the device is sealed by packing E, and clearance between flange D and the device is sealed by packing F.

Casing 1 having upper flange 1*a*, lower flange 1*b* and gear box 1*c* is divided into an upper part and a lower part to enable assembling of inside parts, though a demarcation line of the upper part and lower part and connecting bolts are not shown in FIG. 1.

Inner ring 2 having flange 2*h* is enclosed by casing 1 and is rotatably connected with casing 1 by ball bearing 14 with bolts 15.

Blade 3 has an upper part 3*a* which is inclined in parallel to the surface of cone B, and a lower part 3*b* which is vertical. Lower part 3*b* is connected with inner ring 2 by bolts 3*f*.

Packing 16 and 17 such as an oil seal or grand packing are provided between casing 1 and inner ring 2 at both the top and bottom parts to prevent powder from entering into the device.

Chain sprocket 18 is connected with flange 2*h* of inner ring 2 and ball bearing 14 by bolts 111.

Geared motor 112 is connected with gear box 1*c* by bolts, and output shaft 12*a* is inserted into gear box 1*c*.

Chain sprocket 110 is fitted output shaft 12*a* of geared motor 112 by key and bolts.

Link chain 19 ties chain sprocket 18 and chain sprocket 110 to transfer rotating torque of geared motor 112 to inner ring 2.

The bridge of powder is broken by rotating of blade 3, even at a slow rotating speed such as 0.5-3 rpm.

However, there are problems as for the conventional bridge breaker. 1) The ball bearing 14 receives heavy axial force by gravity of powder, and deformation of the ball bearing 14 causes problems such as stopping of operation or early wearing of the ball bearing. So, housings of the ball bearing 14 should have enough sturdiness, or should be fitted to casing 1 with severe tolerance to utilize sturdiness of the casing 1 and inner ring 2.

However because of a large diameter such as over 200 mm, fabrication of the ball bearing 14, and machining of fitted parts between the ball bearing 14 and casing 1, and between the ball bearing 14 and inner ring 2 are difficult. So much cost and time are required for machining.

2) Packing 16, 17 receive severe abrasion and quick wearing because of existence of powder. Touching parts of packing 16, 17 are worn in a few month of operation, and powder enters into the inside of the device, and finally operation can't be continued.

3) Bolts 3*f* to fix blade 3 to inner ring 2 are loosened easily, and additional fastening of bolts 3*f* is impossible during operation. Once bolts 3*f* are released, bolts 3*f* cause problems such as contamination of powder and damage of downstream equipment.

Furthermore sometimes the screws of bolts 3*f* become stuck in screwed holes, and a lot of repair work is necessary.

SUMMARY OF THE INVENTION

The present invention has objects to provide a bridge breaker that can solve the essential problems of the conventional bridge breaker described above.

The present invention is a bridge breaker consists of casing, rotatable inner ring, blade, balls between casing and inner ring, plug, seal rings, between casing and inner ring, middle gears, drive gear and geared motor.

In order to attain the above object, according to a first aspect of the present invention, there is provided inner ring supported as rotatable by balls and grooves on outside surface of inner ring and on inside surface of casing, and hole for charging balls from outside of casing to these grooves at assembly, and plug to stop this hole.

According to a second aspect of the present invention, there is provided seal rings having sectional shape of square at the clearances between inner ring and casing, and touching at lower side surface of them to horizontal surfaces of inner ring and casing, and depressed by pressure of purge air introduced into device.

According to a third aspect of the present invention, there is provided blade having machined shaft inserted into hole of inner ring.

BRIEF DESCRIPTION OF THE DRAWINGS

FIG. 2 is vertical section view of the bridge breaker the present invention.

FIG. 3 is horizontal section view of the bridge breaker of the present invention.

FIG. 4 shows a detailed layout of a seal ring.

FIG. 5 shows a detailed layout of a connection between the blade and the inner ring.

DETAILED DESCRIPTION OF THE PREFERRED EMBODIMENT

Figure 1:
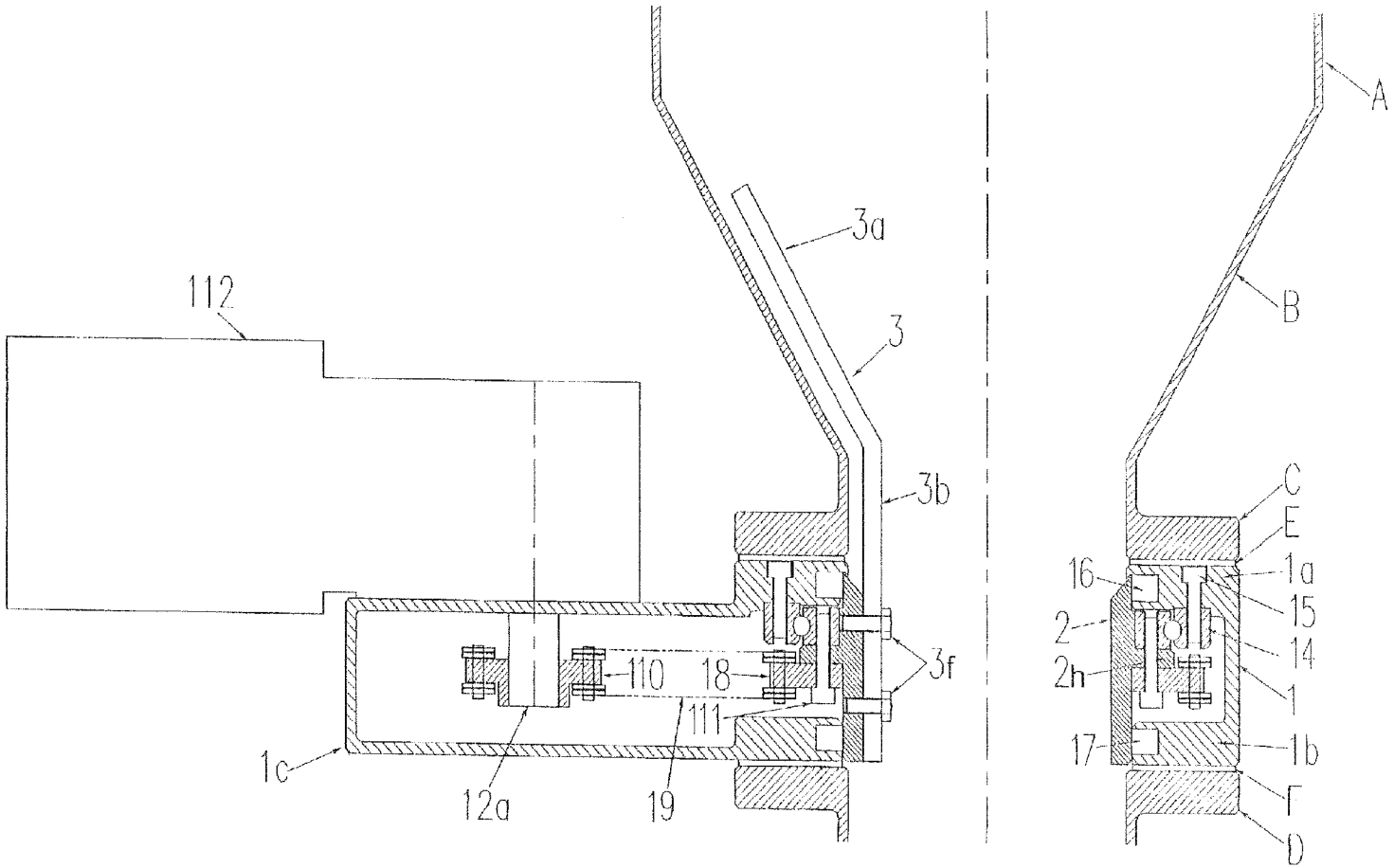
Fig. 1 PRIOR ART
FIG. 1 shows a conventional bridge breaker.
Figure 2:
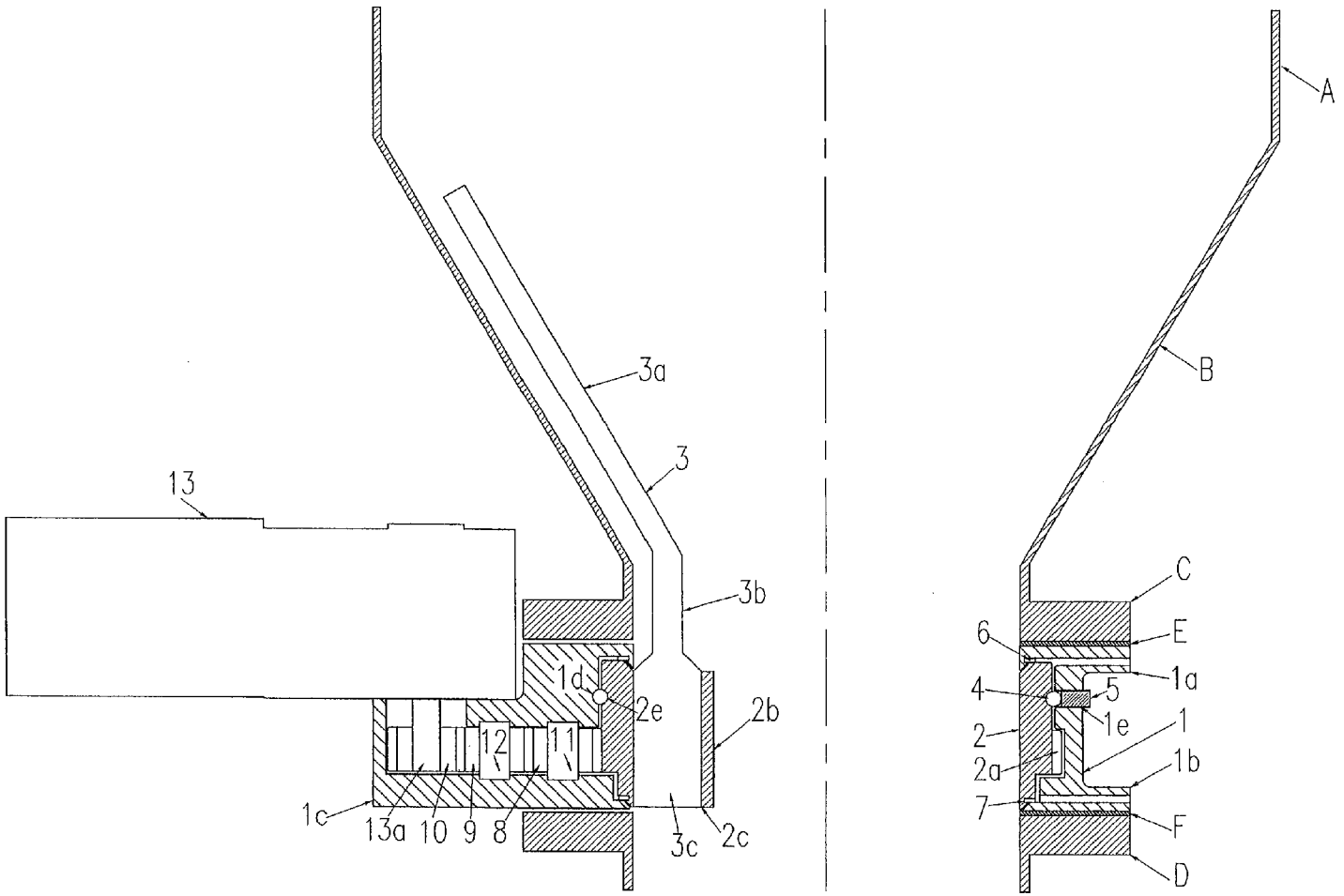
FIGS. 2-5 show the main parts and layout of the present invention.
Figure 5:
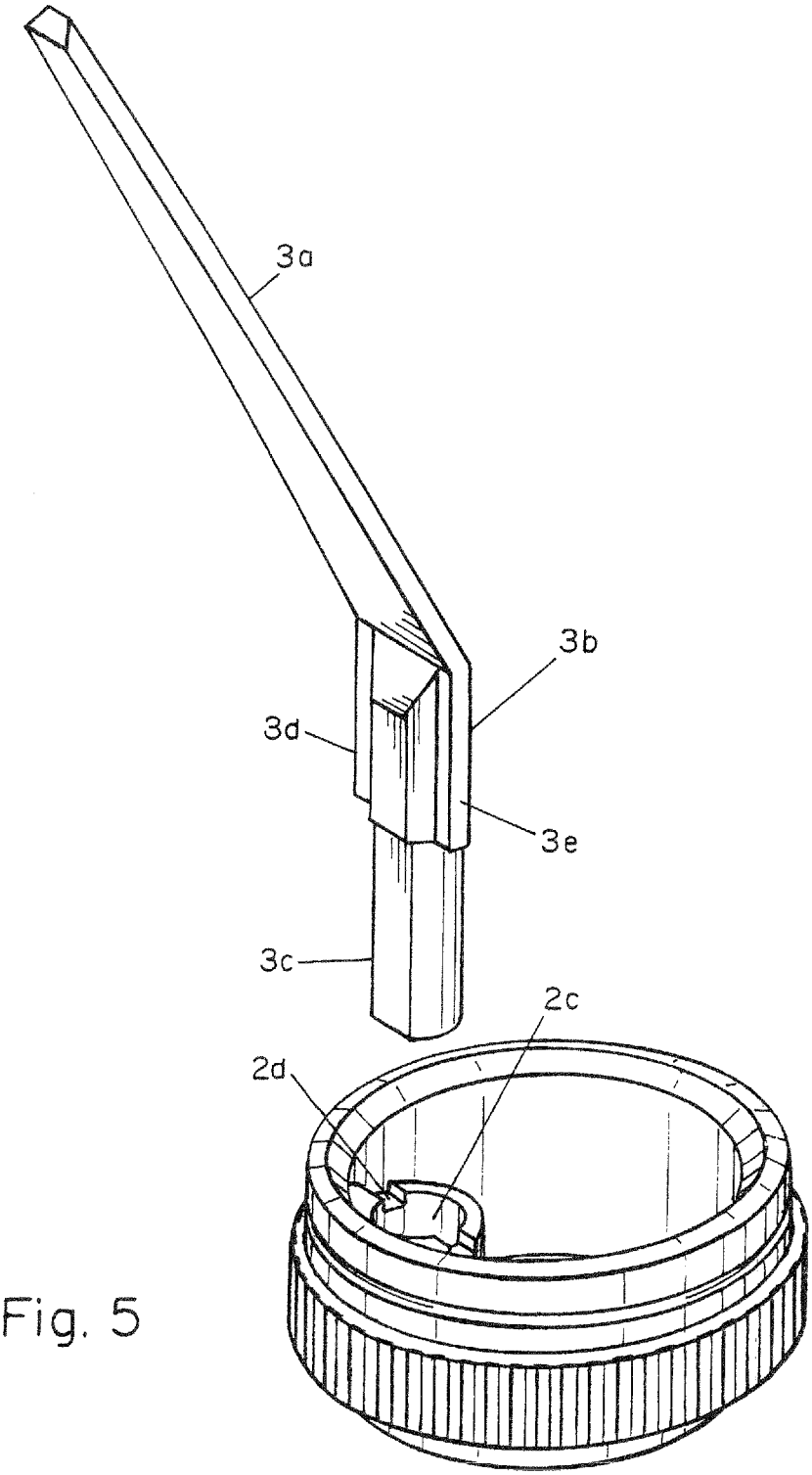

FIG. 2 shows a hopper A to which bridge breaker is connected, the hopper A having cone B and flange C. FIG. 2 further shows flange D of downstream device to which the bridge breaker is connected, and packing E, F for connecting flange surfaces of this device, and casing 1 consisting of an upper casing and lower casing connected with each other by bolts, though the demarcation line of the upper casing and lower casing and connecting bolts are not shown in FIG. 2. As shown in FIG. 2, the casing 1 has upper flange 1*a* and lower flange 1*b* and gear box 1*c*, and having groove 1*d* provided on an inner surface thereof and a hole 1*e* between an outer surface thereof and groove 1*d*. An inner ring 2 is enclosed in casing 1 and has gear 2*a*, overhang part 2*b*, hole 2*c*, and groove 2*e* on outer surface thereof. A blade 3 consists of upper blade 3*a*, vertical part 3*b* and shaft 3*c*, and vertical ribs 3*d* and 3*e* as shown in FIG. 5. Balls 4 are charged in grooves 1*d* and 2*e* of the casing 1 and inner ring 2, and a screwed plug 5 is fitted to hole 1*e*. Seal rings 6 and 7 having a square shape section and made of PTFE or other materials are provided.

Figure 3:
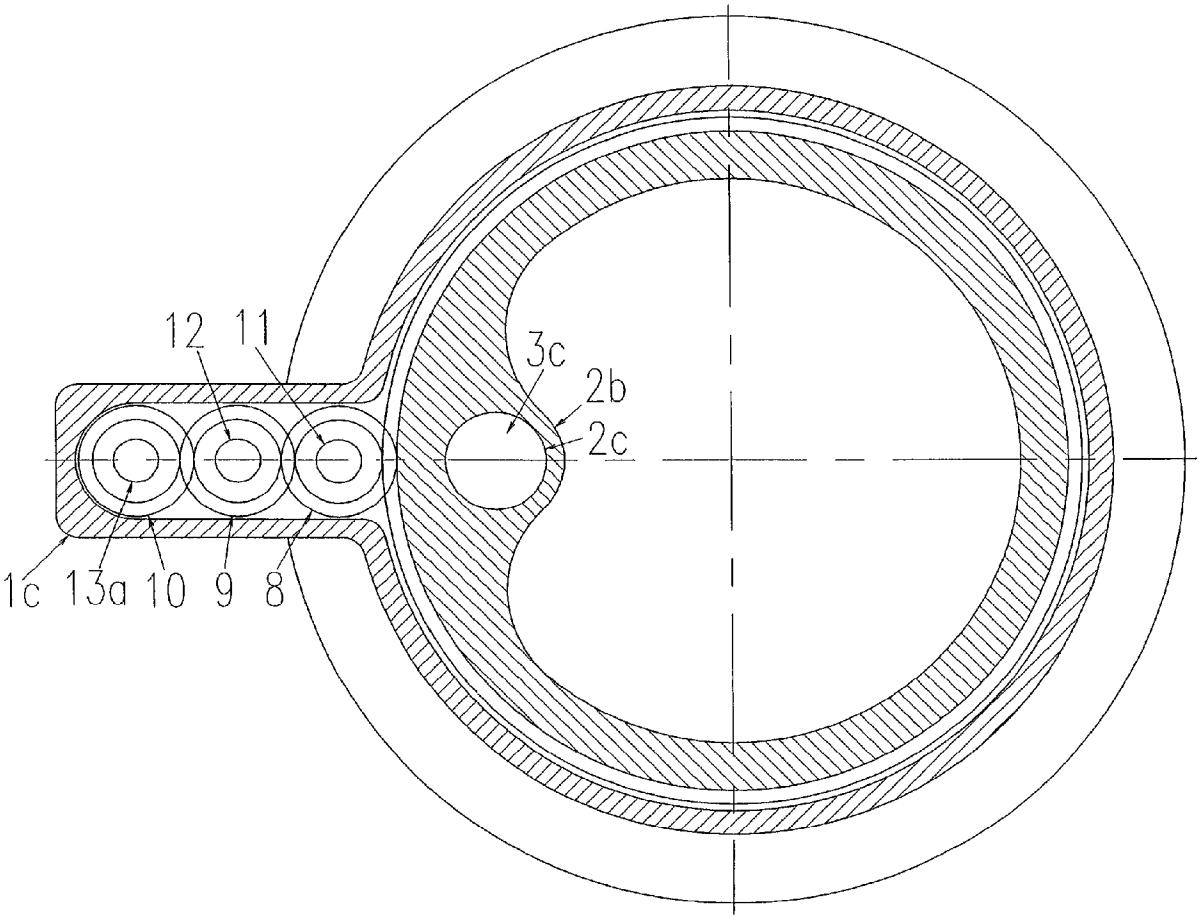

As shown in FIG. 3, the bridge breaker further has middle gears 8 and 9, and drive gear 10, and shafts 11 and 12 for supporting middle gears 8 and 9, and geared motor 13 having output shaft 13*a*.

Figure 4:
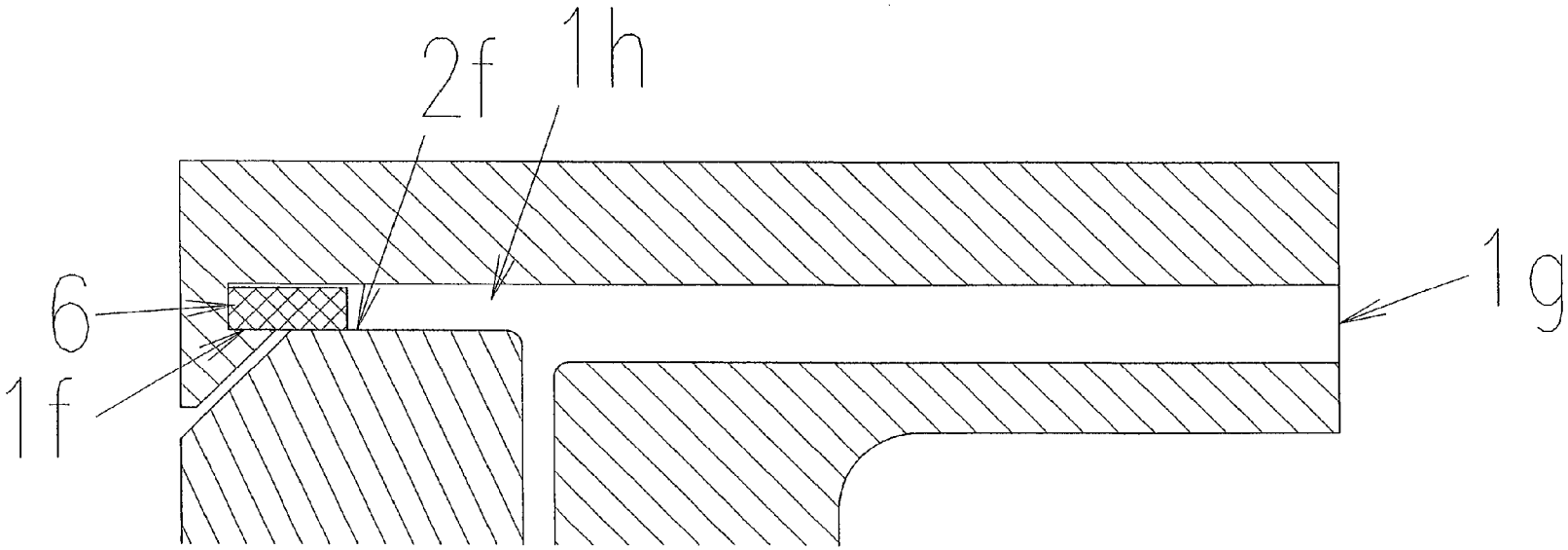

As shown in FIG. 4, contacting surface 1*f* of casing 1 and contacting surface 2*f* of inner ring 2 to seal ring 6 are disposed at a same horizontal level.

And purge air hole 1*g* is provided between circumferential space 1*h* and outer surface of upper flange 1*a*. As for seal ring 7, the construction is same as seal ring 6.

As shown in FIG. 5, for fixing blade 3 to inner ring 2, shaft 3*c* of blade 3 is inserted into hole 2*c* of inner ring 2, and vertical ribs 3*d* and 3*e* of blade 3 are inserted into groove 2*d* of inner ring 2.

In order to attain the above object, according to a first aspect of the present invention, there is provided inner ring supported as rotatable by balls and grooves on outside surface of inner ring and on inside surface of casing, and hole for charging balls from outside of casing to these grooves at assembly, and plug to stop this hole.

Casing 1 and inner ring 2 have enough sturdiness compared with independent ball bearing to support load for balls 4 during operation and also load by clamping force during machining. On the other hand, small clearance such as 0.1 mm between balls 4 and grooves 1*d*, 2*e* is necessary to allow smooth moving of balls even in case of independent ball bearing. This means machining of grooves 1*d* and 2*e* is easier than fitting independent ball bearing to casing 1 and inner ring 2.

Therefore, cost and difficulty of machining are much saved.

In order to attain the above object, according to a second aspect of the present invention, there is provided seal rings having sectional shape of square at the clearances between inner ring and casing, and touching at lower side surface of them to horizontal surfaces of inner ring and casing, and depressed by pressure of air introduced into device.

Air or other gas such as nitrogen having higher pressure than inner pressure of this device is introduced from outside of casing 1 through hole 1*g* to circumferential space 1*h*, and depress seat ring 6 to horizontal surfaces 1*f* and 2*f*. There might be small clearance between seat ring 6 and horizontal surfaces 1*f* and 2*f* caused by allowable tolerance during fabrication such as 0.1 mm.

Air passes through this clearance with high speed more than 10 m/second and powder can't enter into this clearance from inside of this device against air flow. By using material having low abrasion factor such as PTFE for seat rings, and by reason of low depressing force to seat ring 6 by air, wearing of seat rings is much reduced and almost negligible. The situation of seat ring 7 is same as seal ring 6.

In order to attain the above object, according to a third aspect of the present invention, there is provided blade having machined shaft inserted into hole of inner ring.

Blade 3 can't be raised up because of its gravity, and blade 3 receives downward force from powder in hopper A because of the inclination of blade 3. Vertical ribs 3*d*,3*e* inserted into groove 2*d* prevent turning of blade 3. Therefore bolts are not necessary to fix blade 3 and there is no risk that bolts are loosened or released during operation, or that screws of bolts become stuck in screwed hide holes during disassembly of blade 3 from inner ring 2.

The invention claimed is:

1. A bridge breaker comprising:

a casing;

a rotatable inner ring which is provided in the casing; and a blade for bridge breaking which is attached to the inner ring;

wherein:

the casing has an inner surface including an inner groove, and a hole extending from an outer surface of the casing to the inner groove, the inner ring has an outer surface including an outer groove which is arranged to face the inner groove of the casing, thereby defining a space between the outer groove of the inner ring and the inner groove of the casing, balls are provided in the space defined by the inner groove of the casing and the outer groove of the inner ring, so as to rotatably support the inner ring in the casing, the balls are insertable into the space defined by the inner groove of the casing and the outer groove of the inner ring via the hole of the casing at assembly, a plug is provided to plug the hole of the casing, the bridge breaker further comprises seal rings which have a square sectional shape, and are provided in clearances between the inner ring and the casing, the casing and the inner ring have contacting surfaces in the clearances therebetween, the contacting surfaces being at a same horizontal level, the sealing rings have lower side surfaces which contact the contacting surfaces of the casing and the inner ring, and the sealing rings are depressed against the contacting surfaces of the casing and the inner ring by pressure of air or another gas introduced into the bridge breaker.

2. The bridge breaker according to claim 1, wherein the inner ring has a hole, and the blade is inserted into the hole of the inner ring.

* * * * *